US006292946B1

(12) United States Patent
Angione

(10) Patent No.: US 6,292,946 B1
(45) Date of Patent: Sep. 25, 2001

(54) NON-RESILIENT INSERT FOR CATCHING GLOVE

(76) Inventor: Michael Angione, 3 Wayfaring Rd., Norwalk, CT (US) 06851

( * ) Notice: Subject to any disclaimer, the term of this patent is extended or adjusted under 35 U.S.C. 154(b) by 0 days.

(21) Appl. No.: 09/687,294

(22) Filed: Oct. 13, 2000

(51) Int. Cl.[7] ..... A41D 13/00
(52) U.S. Cl. ..... 2/20; 2/19
(58) Field of Search ..... 2/20, 19, 16, 21, 2/160, 161.1, 163, 917

(56) References Cited

U.S. PATENT DOCUMENTS

| | | | |
|---|---|---|---|
| 1,421,308 | * | 6/1922 | Raymond . |
| 1,465,830 | * | 8/1923 | Raymond . |
| 3,890,648 | * | 6/1975 | Beal . |
| 4,121,824 | | 10/1978 | Hirschfield . |
| 4,617,684 | * | 10/1986 | Green et al. . |
| 4,987,611 | * | 1/1991 | Maye . |
| 5,159,717 | | 11/1992 | Drew et al. . |
| 5,173,963 | | 12/1992 | Greenberg . |
| 5,285,529 | | 2/1994 | Arena . |
| 5,398,342 | * | 3/1995 | Kinnee et al. . |
| 5,453,064 | * | 9/1995 | Williams, Jr. . |
| 5,528,772 | | 6/1996 | Cheek . |
| 5,557,803 | | 9/1996 | Granich et al. . |
| 5,604,931 | | 2/1997 | Rhoades . |
| 5,689,828 | | 11/1997 | Mah . |
| 5,768,704 | | 6/1998 | Greenhalgh . |
| 5,976,036 | | 11/1999 | Jackson . |

FOREIGN PATENT DOCUMENTS

2237725-A * 5/1991 (GB) ..... 2/21

* cited by examiner

*Primary Examiner*—Rodney M. Lindsey
(74) *Attorney, Agent, or Firm*—Amster, Rothstein & Ebenstein

(57) ABSTRACT

An insert for a catching glove is easily insertable into and easily removable from a catching glove defining at least two finger sleeves. The insert consists essentially of an essentially non-resilient flexible material such as leather. It defines a palm protector and at least two finger protectors. The palm protector is configured and dimensioned to extend over a wearer's palm and the knuckle joints of the wearer's fingers. Each finger protector extends outwardly from the palm protector and is configured and dimensioned to extend within a respective finger sleeve over at least one joint of a finger in the respective finger sleeve. The at least two finger protectors cooperatively stabilize the insert within the glove against accidental relative slipping. The insert lessens finger sting and palm pain behind the insert when the insert is present in the glove, without introducing ball bounce.

8 Claims, 1 Drawing Sheet

NON-RESILIENT INSERT FOR CATCHING GLOVE

BACKGROUND OF THE INVENTION

The present invention relates to a removable insert for a catching glove, and more particularly to such an insert which lessens finger sting and palm pain behind the insert when the insert is present in the glove, but without introducing ball bounce.

It is well known to provide a removable insert for a glove used in various sports such as baseball, cricket (for the wicket keeper or catcher), frisbee catching, handball, and the like. The insert of the present invention is of the type which is useful in a catching glove (for example, a baseball glove, a cricket glove, or a frisbee glove) wherein an object (for example, the baseball, the cricket ball, the frisbee) is to be caught in the glove. Thus the present invention does not concern gloves for handball and the like where the ball or other object is not caught, but rather hit or re-directed. While the present invention will be described with respect to a baseball glove, it will be clear that the principles of the present invention apply to all catching gloves—for example, cricket gloves and frisbee gloves.

There are two major types of inserts for use in catching gloves, such as baseball gloves. The less common type of insert is formed of a relatively rigid non-resilient material which prevents the wearer from closing the glove about the object being caught. This type of insert is commonly used as a training tool in order to force players to get into the habit of catching with two hands (as opposed to just the glove hand) because use of the non-glove hand is necessary to prevent the ball from rolling out of the glove hand.

By far a more common type of insert is formed of a resilient material (such as foam or rubber), thereby to lessen the finger sting and palm pain behind the insert when the insert is present in the glove. The insert may consist exclusively of the resilient material, or the resilient material may be enclosed in a pocket of resilient or non-resilient material in order to better retain its shape, provide a suitable feel to the wearer, and the like.

The conventional inserts for a catching glove have not proven to be entirely satisfactory in use. Whether the object is a baseball (whether hard ball or soft ball), a frisbee, or a cricket ball, the resilient material thereof imparts to the glove "ball bounce." Ball bounce occurs when the ball impacts upon the glove and thereby initially compresses the insert, followed by the insert resiliently resuming its original configuration and thereby generating a force which causes the ball to bounce out of the glove (whether back along its original trajectory towards the glove or a different trajectory). While such "ball bounce" may be acceptable in sports where the ball is not to be caught, but rather simply struck (for example, handball), it is unsuitable for use in sports where the glove is used for catching the ball.

Accordingly, it is an object of the present invention to provide an insert for a catching glove wherein the insert lessens finger sting and palm pain behind the finger when the insert is present in the glove, without introducing ball bounce.

Another object is to provide such an insert which defines a palm protector and at least two finger protectors to stabilize the position of the palm protector within the glove.

A further object is to provide such an insert which is easily insertable into and easily removable from a catching glove.

SUMMARY OF THE INVENTION

The above and related objects of the present invention are obtained in an insert for a catching glove defining at least two finger sleeves. The glove comprises an insert easily insertable into and easily removable from a catching glove defining at least two finger sleeves, the insert consisting essentially of an essentially non-resilient flexible material. The insert defines a palm protector and at least two finger protectors. The palm protector is configured and dimensioned to extend over a wearer's palm and the knuckle joints of the wearer's fingers. Each finger protector extends outwardly from the palm protector and is configured and dimensioned to extend within a respective finger sleeve over at least one joint of a finger in the respective finger sleeve. The at least two finger protectors cooperatively stabilize the insert within the glove against relative slipping. Thus, the insert lessens finger sting and palm pain behind the insert when the insert is present in the glove without introducing ball bounce.

The insert material is preferably leather and has a rough surface facing the glove and a relatively smooth surface facing the wearer's hand.

The present invention also encompasses the combination of a catching glove and the insert, the glove being, for example, a baseball glove, a cricket glove or a frisbee glove. Preferably the material is a leather substantially similar in composition and thickness to the leather of the glove.

BRIEF DESCRIPTION OF THE DRAWING

The above and related objects, features and advantages of the present invention will be more fully understood by reference to the following detailed description of the presently preferred, albeit illustrative, embodiments of the present invention, when taken in conjunction with the accompanying drawing wherein.

DETAILED DESCRIPTION OF THE PREFERRED EMBODIMENTS

Figure 1:
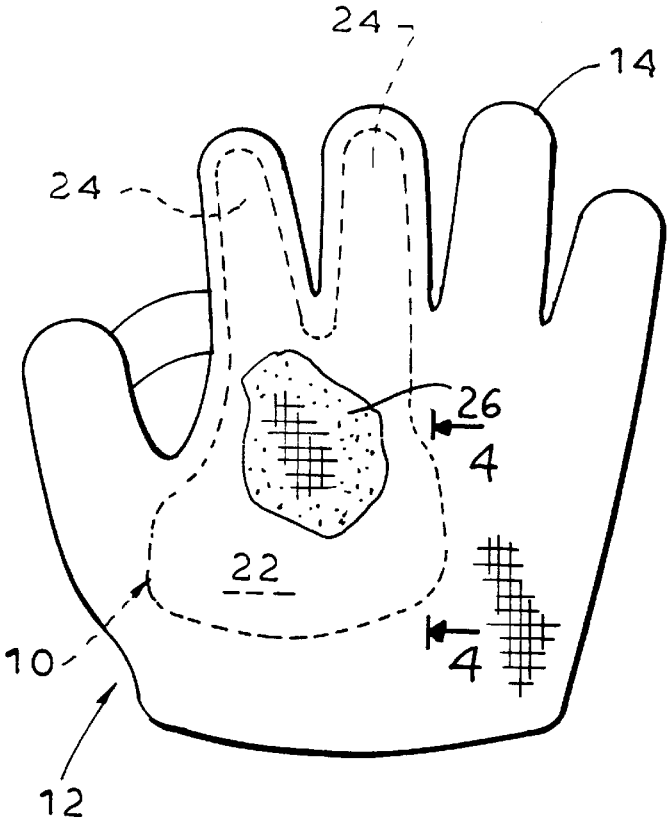
FIG. 1 is a front elevational view of a baseball glove and an insert therefor, the position of the insert within the glove being illustrated in dotted line.
Figure 4:
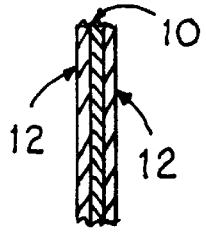
FIG. 4 is a sectional view taken along line 4—4 of FIG. 1.

Referring now to FIG. 1, therein illustrated is an insert according to the present invention, generally designated by the reference numeral 10. The insert 10 is configured and dimensioned to be easily insertable into and easily removable from a catching glove, generally designated 12. The glove 12, as illustrated, is a baseball glove, but may also be a cricket glove, frisbee glove, or similar catching glove.

Still referring to FIG. 1 in particular, the catching glove 12 defines at least two finger sleeves 14 and may have as many as five finger sleeves 14 (one for each finger, including the thumb, of the wearer's hand). Each finger sleeve 14 may be configured and dimensioned to receive therein one, two or even more fingers of the wearer's hand. The glove 12 is of conventional design and hence further details thereof need not be specified herein.

Figure 2:
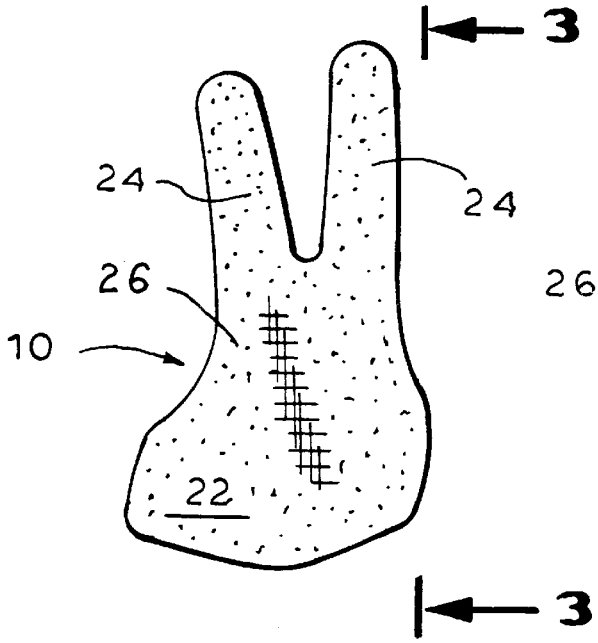
FIG. 2 is a front elevational view of the insert.
Figure 3:
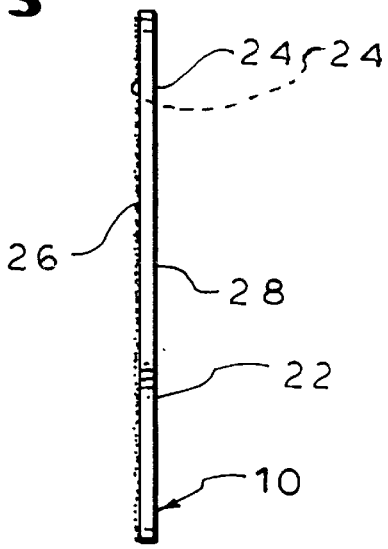
FIG. 3 is a side elevational view thereof taken along the line 3—3 of FIG. 2.

Referring now to FIGS. 2 and 3 in particular, the insert 10 according to the present invention defines a palm protector 22 and at least two finger protectors 24. The palm protector 22 is configured and dimensioned to extend over a wearer's palm and the knuckle joints of the wearer's fingers (which connect the fingers and the palm). Each finger protector 24 extends outwardly from the palm protector 22 (preferably in a V-shaped configuration of the two finger protectors). Each finger protector 24 is configured and dimensioned to extend within a respective finger sleeve 14 over at least one joint of a finger in the respective finger sleeve 14 (and preferably over at least one joint of each of the fingers in the respective finger sleeve 14) beyond the knuckle joint. The at least two finger protectors 24 cooperatively stabilize the insert 10, and particularly the palm protector 22, within the glove against accidental relative slipping. Thus the finger protectors 24 assist in maintaining proper positioning of the palm protector 22 with a security that cannot be obtained with only a single finger protector 24.

When the insert 10 is properly inserted into the hollow of a glove (in front of the wearer's hand), the insert lessens finger sting and palm pain behind the insert, thus protecting the wearer's hand, without introducing ball bounce. In order to avoid the introduction of ball bounce, the insert consists essentially of an essentially non-resilient flexible material. The insert is preferably formed of leather, and in particular a leather which is substantially similar in composition and thickness to the leather of the glove 12, especially the leather of the palm of the glove.

The insert 10 consists essentially of the essentially non-resilient flexible material, but may further include an outer covering or the like which is formed of a resilient or non-resilient material, provided only that the outer covering does not appreciably reintroduce ball bounce. Such an outer covering may be of such thinness that its compression and release does not generate appreciable forces tending to produce ball bounce. Preferably, however, the outer covering will be formed of an essentially non-resilient material.

In order to assist in maintaining the insert in place within the glove 12, it is preferably formed of a material having a rough surface 26 facing the glove 12 and a relatively smooth surface 28 facing the wearer's hand.

While most materials possess at least a certain degree of resiliency (such that they tend after compression and release to return to or towards their original configuration), for the purposes of the present invention glove leather will be deemed herein as an essentially non-resilient material. While the presence of the insert 10 within the glove 12 may limit the degree to which the caught ball may enter the pocket of the glove 12 (because it tends to make the pocket more shallow than if the insert were not present in the glove), the insert 10 does not introduce ball bounce tending to eject the ball from the glove pocket as would a comparable insert of a resilient nature.

To summarize, the present invention provides an insert for a catching glove wherein the insert lessens finger sting and palm pain behind the insert (when the insert is present in the glove), without introducing ball bounce. The insert defines a palm protector and at least two finger protectors to stabilize the position of the palm protector within the glove. The insert is easily insertable into and easily removable from a catching glove.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing disclosure.

I claim:

1. An insert for a catching glove defining at least two finger sleeves, comprising:

an insert easily insertable into and easily removable from the hand-receiving volume of a catching glove defining at least two finger sleeves, said insert consisting essentially of an essentially non-resilient flexible material and defining:

(A) a palm protector, said palm protector being configured and dimensioned to extend over a wearer's palm and the knuckle joints of the wearer's fingers; and (B) at least two finger protectors, each finger protector extending outwardly from said palm protector and being configured and dimensioned to extend within a respective finger sleeve over at least one joint of a finger in the respective finger sleeve, said at least two finger protectors cooperatively stabilizing said insert within the glove against accidental relative slipping;

whereby said insert lessens finger sting and palm pain behind said insert when said insert is present in the glove, without introducing ball bounce.

2. The insert of claim 1 wherein said material is leather.

3. The insert of claim 1 wherein said material has a rough surface for facing the glove and a relatively smooth surface for facing and being adjacent the wearer's hand.

4. In combination, the insert of claim 1 and a catching glove of leather defining at least two fingers sleeves.

5. The combination of claim 4 wherein said glove is a baseball glove.

6. The combination of claim 4 wherein said material is leather substantially similar in composition and thickness to the leather of said glove.

7. An insert for a catching glove defining at least two finger sleeves, comprising:

an insert easily insertable into and easily removable from the hand-receiving volume of a catching glove defining at least two finger sleeves, said insert consisting essentially of an essentially non-resilient flexible leather having a rough surface for facing the glove and a relatively smooth surface for facing and being adjacent the wearer's hand and defining:

(A) a palm protector, said palm protector being configured and dimensioned to extend over a wearer's palm and the knuckle joints of the wearer's fingers; and (B) at least two finger protectors, each finger protector extending outwardly from said palm protector and being configured and dimensioned to extend within a respective finger sleeve over at least one joint of a finger in the respective finger sleeve, said at least two finger protectors cooperatively stabilizing said insert within the glove against accidental relative slipping;

whereby said insert lessens finger sting and palm pain behind said insert when said insert is present in the glove, without introducing ball bounce.

8. In combination, the insert of claim 7 and a baseball glove of leather defining at least two fingers sleeves, said leather of said insert being substantially similar in composition and thickness to said leather of said glove.

* * * * *